US008267474B2

(12) United States Patent
Fetisoff

(10) Patent No.: US 8,267,474 B2
(45) Date of Patent: Sep. 18, 2012

(54) PORTABLE SELF-CONTAINED PNEUMATIC LIFT CHAIR

(76) Inventor: Valentine A. Fetisoff, Annandale, VA (US)

( * ) Notice: Subject to any disclaimer, the term of this patent is extended or adjusted under 35 U.S.C. 154(b) by 1398 days.

(21) Appl. No.: 11/254,757

(22) Filed: Oct. 21, 2005

(65) Prior Publication Data

US 2007/0102978 A1 May 10, 2007

(51) Int. Cl.
*A47C 3/20* (2006.01)

(52) U.S. Cl. ..... 297/338; 297/344.18; 297/DIG. 8

(58) Field of Classification Search ..... 297/338, 297/339, 344.12, 344.18, 344.19, 344.16, 297/DIG. 10
See application file for complete search history.

(56) References Cited

U.S. PATENT DOCUMENTS 1,326,746 A * 12/1919 Kunath ..... 108/90
2,679,283 A * 5/1954 Mahone ..... 297/344.18
2,850,075 A * 9/1958 Wilson ..... 297/339
4,232,901 A * 11/1980 Harrington et al. ..... 297/423.45
4,538,854 A * 9/1985 Wilson ..... 297/344.2
4,545,616 A * 10/1985 Booth ..... 297/320
4,690,457 A * 9/1987 Poncy et al. ..... 297/337
4,778,216 A 10/1988 Stupakis
4,930,839 A * 6/1990 Saito et al. ..... 297/338
4,993,736 A * 2/1991 Garman et al. ..... 280/304.1
5,161,812 A * 11/1992 DeWeese ..... 280/47.38
5,377,366 A 1/1995 Boyd et al.
5,579,544 A * 12/1996 Attler ..... 4/566.1
5,624,159 A * 4/1997 Celoni et al. ..... 297/325
5,722,716 A * 3/1998 Thomas et al. ..... 297/118
5,853,015 A * 12/1998 Evans ..... 135/67
6,783,179 B2 8/2004 Komura et al.
2005/0173953 A1 * 8/2005 Riley ..... 297/228.1

FOREIGN PATENT DOCUMENTS

WO WO-92/14432 A1 * 9/1992

* cited by examiner

*Primary Examiner* — Peter R. Brown
(74) *Attorney, Agent, or Firm* — Clyde I. Coughenour

(57) ABSTRACT

A portable self-contained pneumatic lift chair is provided with a motor operated compressor and controls for pumping air into a bladder and exhausting air from the bladder to raise and lower patients seated on the chair. The seat is guided up and down by loops on the seat surrounding guideposts extending upward on a base under hand operated controls. Braces between the posts are used to make the chair sturdy and can be adjusted to control the distance the chair is raised and lowered and, with post height and bladder size, used to control maximum and minimum height of the seat.

14 Claims, 5 Drawing Sheets

PORTABLE SELF-CONTAINED PNEUMATIC LIFT CHAIR

BACKGROUND OF THE INVENTION

1. Field of the Invention

A wheeled portable chair includes a self-contained air compressor, bladder, tubing and controls for lifting and lowering a handicapped person seated on the chair.

2. Description of Related Art

The present patent is an improvement or modification of prior art chair lifts. The use of air pressure as a means for elevating a chair seat is old as is the inclusion of the means for building up pressure to facilitate elevation. R. Wilson (U.S. Pat. No. 4,538,854, issued 3 Sep. 1985) and J. Stupakis (U.S. Pat. No. 4,778,216, issued 18 Oct. 1988) and German et al (U.S. Pat. No. 4,993,736 issued 19 Feb. 1991) and Boyd et al (U.S. Pat. No. 5,377,366, issued 3 Jan. 1995) are examples. A. Attler (U.S. Pat. No. 5,579,544, issued 3 Dec. 1996) is an example of a bath tub seat raised up by an inflatable cushion that raises a seat on guide posts that can use water as the lifting force. Komura et al (U.S. Pat. No. 6,783,179, issued 31 Aug. 2004) is an example of a wheeled chair having lockable wheels.

SUMMARY OF THE INVENTION

A sturdy chair for assisting in the elevation of handicapped persons, such as the elderly, arthritic and otherwise impaired, into SUV's and similar height, elevated vehicles, and use in homes and institutions such as hospitals and nursing homes. The chair makes the lives of all the involved persons easier. The handicapped person needs less handling and the amount of lifting required by attendants assisting the handicapped person, such as friends, relatives, doctors and nurses, is reduced. Often only one person is needed to help the handicapped person get seated and to make adjustments. The chair has lock wheels, for portability, and sturdy seating, patient support, and a self-contained power source. The power source includes a motor, air compressor, bladder, tubing and controls for raising and lowering the seat of the chair to elevate and lower the patient. The seat is above an air bladder with a lower end in an open top box, that can essentially contain the bladder when deflated, over a housing for the activating components. The seat vertically reciprocates, on guide posts extending from the base and spaced by braces, and can have a cover to shield the occupant from the bladder, control leads and tubing. The box is preferably attached to lower braces.

DESCRIPTION OF THE PREFERRED EMBODIMENTS

Figure 1:
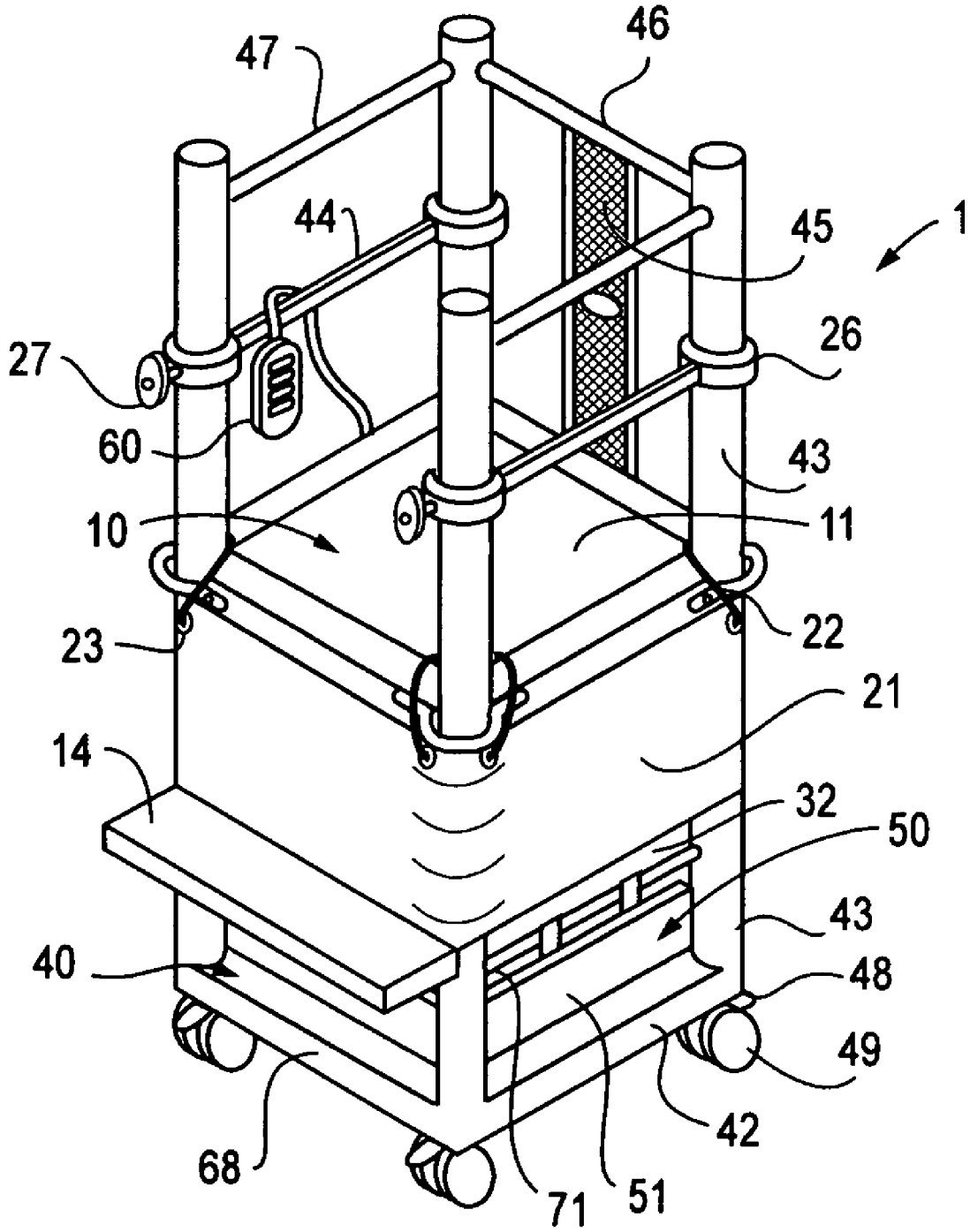
FIG. 1 is a perspective view of the lift chair of the invention in a raised position.
Figure 2:
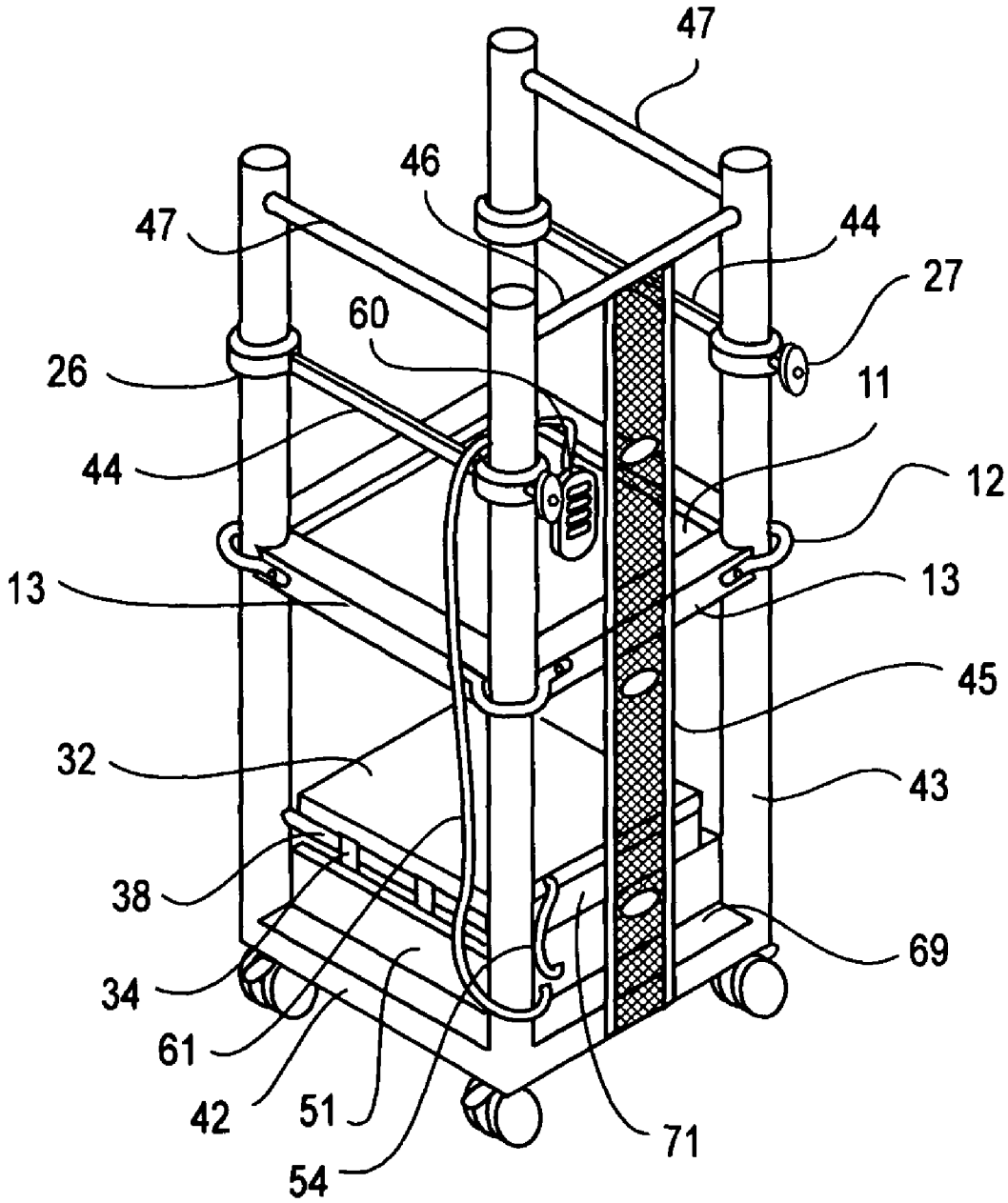
FIG. 2 is a perspective view of the lift chair of FIG. 1 with the skirt guard removed showing internal components.

FIG. 1 shows the chair ready for use. FIG. 2 shows the chair with skirt, shield or guard 21 removed to reveal the various components.

The lift chair 1 is self-contained. It includes a seat 10 with foot rest 14, a chair base 40 with guides 43*r*, a backrest 45, a bladder 30 wheels 49 for supporting the base and a housing 50, with sides 51 for power and control components.

Figure 3:
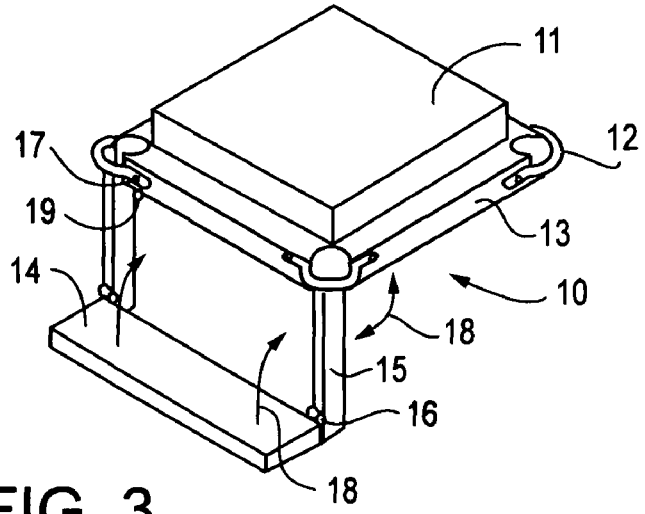
FIG. 3 is a perspective view of the seat of the invention.

The seat 10, FIG. 3, is made of a rigid seat support 13 and cushion 11 for seating a patient. A foot rest 14 is attached to the rigid support by extensions 15 that support the patient's feet while sitting on the seat. The footrest has hinges 16 for pivoting 18 relative to the extensions 15 and the extensions have hinges 19 for pivoting 18 to the seat support 13 for storage. The corners of the seat have removable 17 sturdy, rigid loops 12 attached for guiding the seat up and down on the guides 43 affixed to the chair base 40.

Figure 4:
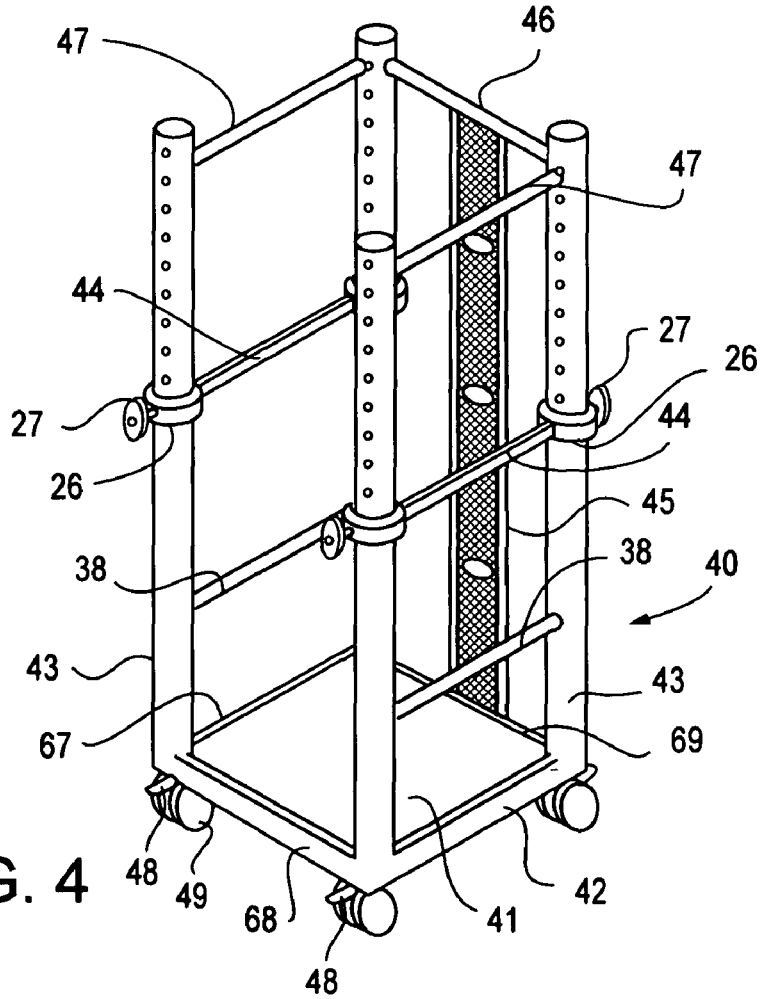
FIG. 4 is a perspective view of the chair base of the invention.

The chair base 40, FIG. 4, of the lift chair 1 has a plate 41 that supports tracks or guideposts 43, at the four corners, that extend up vertically and pass through the rigid guide loops 12 attached to the four corners of the seat 10 support 13. A back brace 45 extends vertically at the rear of the chair between upper brace 46 and lower brace 69. The upper ends of the guideposts are held or secured in position by braces 46,47 that extend between the guide posts. The rigid guide loops 12 on the seat extend over the guideposts and can reciprocate between the lower 38 and upper 47 braces so that the seat can move the patient vertically. The braces can be permanently attached to the guideposts or they can be adjustably secured by clamps 26 and lock screws 27 on the ends of the braces. It is preferred that the upper braces 47 and lower braces 38 as well as the braces 42,67,68,69 be permanently secured to the guide posts 43 for firmness and security. The braces 44 can be used to adjust the maximum height the seat can be raised to or the minimum extent the seat can be lowered to or they can be omitted. The guideposts 43 can be made of aluminum or steel and can be oval, circular or square. The components can be riveted, bolted or welded together for permanent or temporary assembly. The base plate 41 supports a housing 50 for the electrical and mechanical components and is in turn supported by wheels 49. The lift chair is made portable by providing lock wheels or rollers 49 at the corners. The wheels or rollers have a foot operated lever 48 that releases the wheels or rollers for easy rotation or clamps them in place to preclude movement of the lift chair during use.

Figure 6:
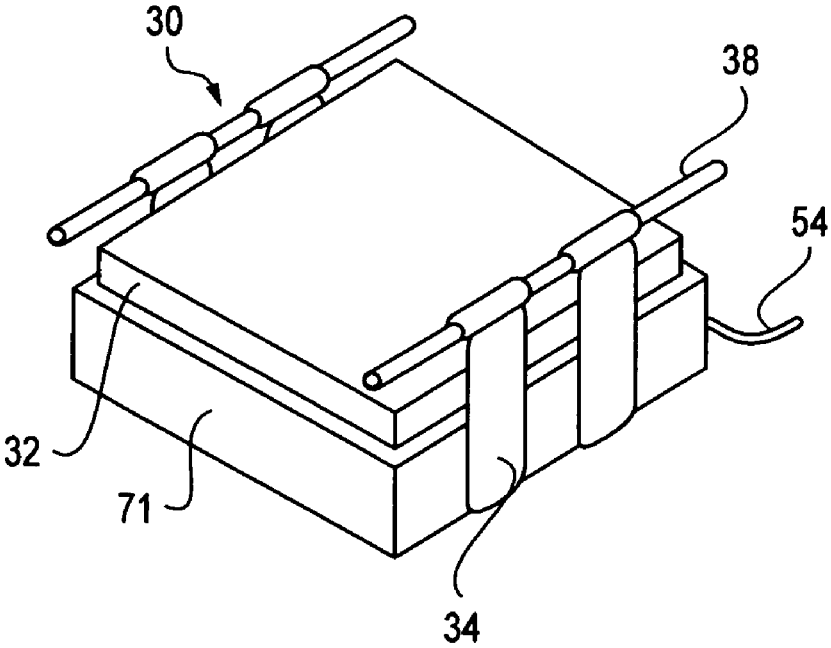
FIGS. 6 and 7 are perspective views of the bellows of the invention in the deflated and inflated positions respectively.
Figure 7:
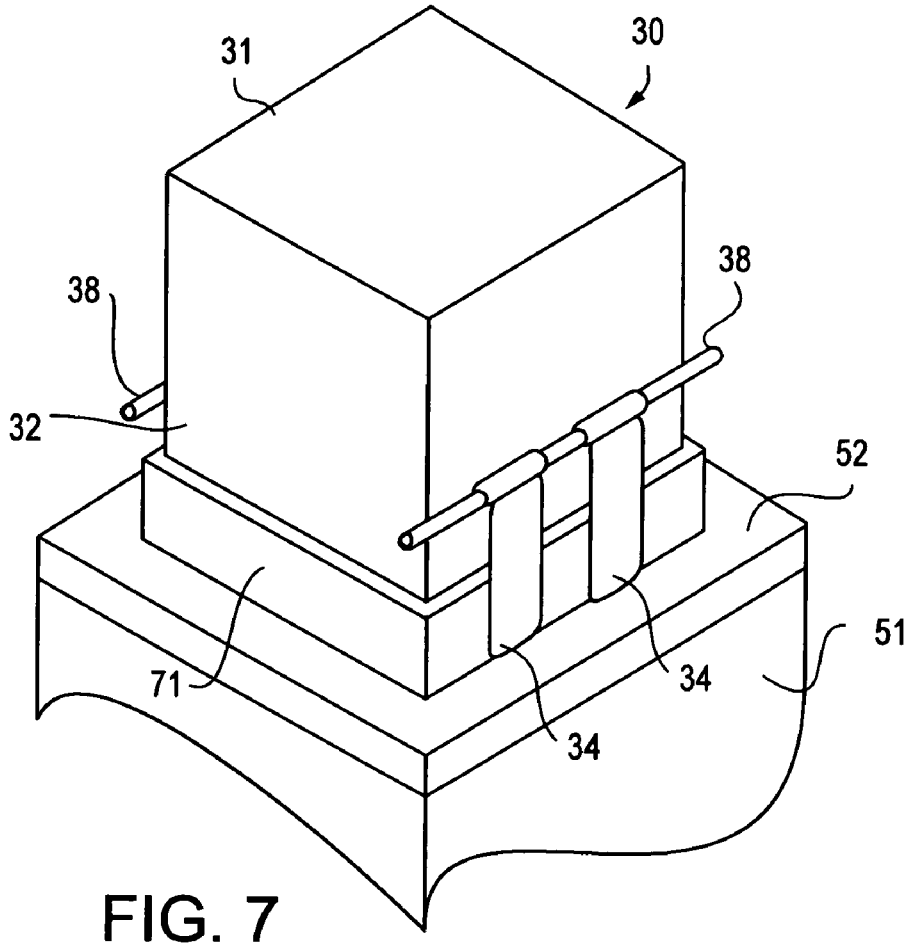

The bladder 30, FIGS. 6 and 7, is located between the housing top 52 and the bottom of the seat 13 and rests in an open top box 71. The bladder 30 in FIG. 6 is deflated and in an open top box 71 supported by brackets 34 to the lower braces 38 with the housing 51 and cover 52 shown below the open top bladder box 71 in FIG. 7. The bladder 30 can be a flexible, shaped plastic material, with flat sides having top 31 and bottom surfaces that can abut when collapsed due to release of air pressure and separate when air is pumped into the bladder, to raise the seat. The bladder can alternately have accordion type sides 32 that flatten when air pressure is introduced and collapse when the air is exhausted to raise and lower the seat 10. A third alternative that can be employed is to have an elastic bladder that stretches when inflated and contracts when deflated presenting a smooth outer surface that needs no shield. As a fourth alternative, a piston type arrangement can be established. Any pumping of air into the bladder will elevate the seat 10 and lift a person placed on the seat. The bladder can be made of a soft rubber like material similar to an automobile tire inner tube or an exercise ball or of a tear resistant special soft yet heavy tear resistant plastic. The bladder can be from 0.015 to 0.090 inches thick and from 12 to 24 inches wide and extend from 1 to 24 inches or more high. When deflated, the bladder 30 can be totally or predominantly housed within the box 71. While the box could be secured or positioned on the housing 51 cover 52, it is preferred that the box be secured to the lower brace 38. This box is secured to the brace 38 by a bracket 34 that extends under the box 71 above the housing cover 52.

Figure 8:
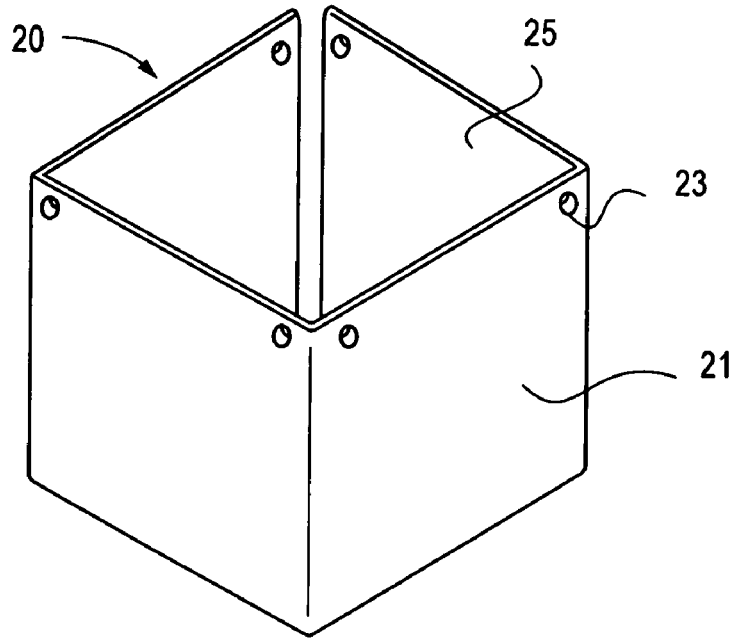
FIG. 8 is a perspective view of the skirt, shield or guard of the invention.

Air is pumped into the bladder and released from the bladder through one or two hoses 54,55. It is preferred that only one hose be exposed and connected to the bladder to reduce accidents and the possibility of leakage. One or more elevation skirt, shields or guards 20, FIG. 8, can be provided to enclose the bladder 30 and housing 50. It is preferred that the guard 20 be attached to the periphery of the seat 13 to rise and fall with the seat and conceal the bladder and prevent contact between the bladder and any portion of a person seated in the chair or standing beside it. The guard can be secured to the seat using cords or wires 22 that extend through eyelets 23 in the upper area of the skirt shield or guard sides 21. The guide loops can optionally be covered. A back skirt or shield 25 can be used or omitted depending on the wishes of the user and physical involvement.

The vertical limit of the seat is determined by the height of the guideposts 43 and vertical limit or expandability of the bladder 30 and spacing of the side braces 38,44,47 and they determine the height the handicapped person can be elevated to, i.e. the maximum operation height of the chair. As previously stated, the side rails can be provided with clamps 26 having locking provisions 27 to adjustably secure the side rails or braces 44 to the guide posts 43 to adjust the maximum or minimum elevation of the seat 10 when used. The seat 11 is wide enough to extend adjacent under and or over the side braces 38,44,47.

Figure 5:
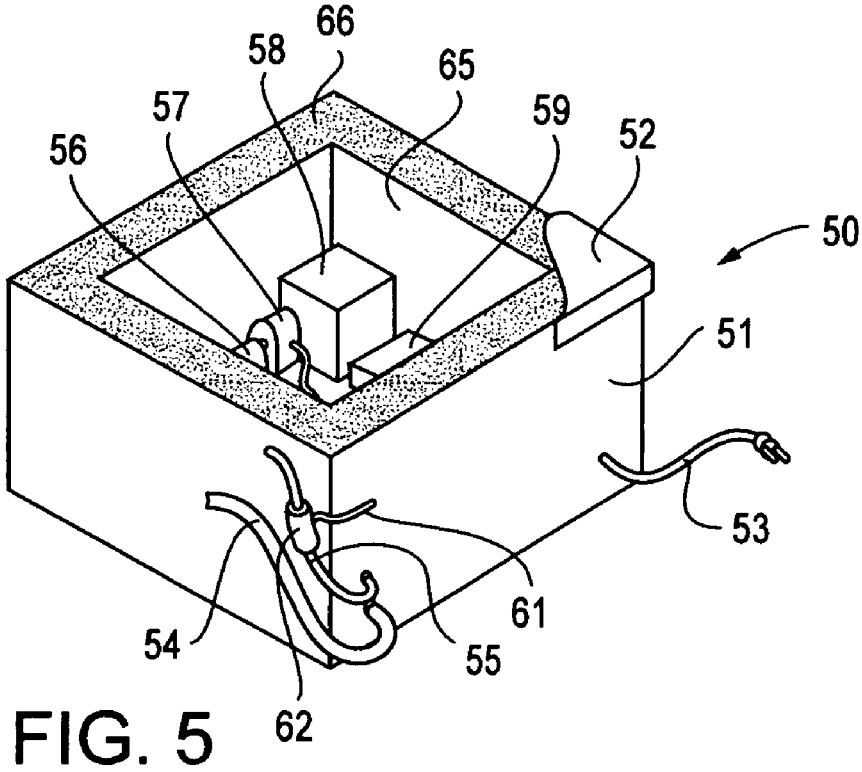
FIG. 5 is a perspective view of the control housing of the invention.

The housing 50 in FIG. 5 contains the electric motor 56 and air compressor 57 and control box 59 and a muffler can be included, with or without insulation, to reduce the noise generated in the air compression process. The noise reduction provisions shown in FIG. 5 are an outer box 51 having an inner box 65 with insulation 66 between the two boxes. The motion is provided by a motor 56 that can be powered by a 120/220 volt AC or a DC battery 58 and pump producing 150 psi at 3.3 amps to raise a person weighing over 200 lbs. The motor and compressor are held within the housing or enclosure below a bladder box 71 to make the lift chair combination self-contained. The housing 50 can be supported on the base plate 41 or attached to the lower braces 38. The air pump or compressor 57, the motor 56 to operate it, and the control box 59, can be permanently attached to the chair or removable for inspection and repair. The only external need for operating the device is the power source 53 when a battery 58 is not employed. An electric extension cord and switch are included with the housing for plugging into a wall socket.

The electrical controls 60 with leads 61 are portable and can be placed on one of the guideposts 43 or braces 44, 47 so as to be accessible to both a handicapped person and an assistant. The controls 60 activate and deactivate the compressor motor 56 of the compressor 57 and the valves that control air flow into the bladder 30 and from the bladder through plastic hoses 54, 55. A restrictor 62 can be used with the exhaust hose 55 to control the rate the seat descends under control of an electrical connection 61 from the control box 59 operated from the hand controls 60. The rate of lift is determined by the motor size and speed and compressor size.

An external air source, such as found in hospitals, can be used. The only component of the chair that requires an external source is the electric cord to be used with a standard wall socket.

The chair, being provided with high guideposts and back, in combination with side and back braces forms a strong support for any handicapped person using the chair. These in combination with a foot rest firmly attached to the seat provide a secure, safe means for elevating a handicapped person.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A portable pneumatic lift chair comprising:

a base with vertically extending parallel guide posts;

a vertically reciprocal seat attached to said parallel guide posts;

a bladder positioned between said base and said vertically reciprocal seat;

an air compressor for inflating said bladder and lifting said vertically reciprocal seat;

braces extending between said guide posts to rigidify said base, said parallel guide posts and said vertically reciprocal seat;

said braces include adjustable braces slidable along said parallel guide posts and firmly positionable to both rigidify said base, said parallel guide posts and said vertically reciprocal seat and to control the extent said seat can be raised;

said vertically reciprocal seat has a foot rest attached thereto for supporting a patient's feet when sitting on said vertically reciprocal seat;

said bladder being supported by an open top box;

said open top box being supported by said braces extending between said parallel guide posts;

a control housing on said base under said bladder supporting open top box;

means in said control housing for operating said air compressor.

2. A portable pneumatic lift chair comprising:

a base supporting a vertically reciprocal seat;

a bladder positioned between said base and said vertically reciprocal seat;

an air compressor for inflating said bladder and lifting said vertically reciprocal seat;

said vertically reciprocal seat has a foot rest attached thereto and movable therewith for supporting a patient's feet when sitting on said vertically reciprocal seat;

a skirt shield attached to said vertically reciprocal seat and extending from said vertically reciprocal seat to said foot rest for covering said bladder and preventing contact between a patient and said bladder before and during reciprocal movement of said vertically reciprocal seat.

3. A portable pneumatic lift chair as in claim 2 including:

vertically extending parallel guide posts on said base;

loops secured to said vertically reciprocal seat;

said loops extend around said parallel guide posts for guiding said vertically reciprocal seat vertically on said parallel guide posts.

4. A portable pneumatic lift chair as in claim 3 including;

braces extending between said parallel guide posts to rigidify said base, said vertically reciprocal seat and said parallel guide posts, said bladder being supported by an open top box;

said open top box being supported by said braces extending between said parallel guide posts on said base;

a control housing on said base under said bladder supporting said open top box;

means within said control housing for operating said air compressor.

5. A portable pneumatic lift chair as in claim 3 including;

braces extending between said parallel guide posts to rigidify said base and said vertically reciprocal seat and said parallel guide posts;

said braces include adjustable braces slideable along said parallel guide posts and positionable to control the extent said seat can be raised.

6. A portable pneumatic lift chair as in claim 5 wherein:

each end of each of said adjustable braces is provided with clamps and lock screws to secure said adjustable braces in a selected position.

7. A portable pneumatic lift chair as in claim 2 including:

wheels on said base for moving said lift chair;

locks on said wheels for preventing rotation of said wheels.

8. A portable pneumatic lift chair as in claim 2 wherein:

said skirt shield is attached to said vertically reciprocal seat by cords extending around said parallel guide posts and into eyelets in said skirt shield.

9. A portable lift chair comprising:

a vertically reciprocal seat;

a base for supporting said vertically reciprocal seat;

vertically extending parallel guide posts extend upwardly from said base;

braces extending between said parallel guide posts to rigidify said base and said parallel guide posts;

a back rest extending vertically from said base parallel to said parallel guide posts for supporting the back of a patient;

said back rest is secured to said base and to one of said braces extending between said parallel guide posts;

a base plate on said base supporting a housing;

said housing containing electrically driven components for moving said vertically reciprocal seat including an electric motor and an air compressor supported by said base plate;

an open top box above said housing for supporting a bladder used to vertically reciprocate said vertically reciprocal seat;

said open top box being supported by two of said braces extending between said parallel guide posts;

a rate of motion control to limit the descent rate of said vertically reciprocal seat.

10. A portable lift chair as in claim 9 including:

said braces include adjustable braces slideable along said parallel guide posts.

11. A portable lift chair as in claim 10 including:

a bladder positioned above said base in said open top box.

12. A portable lift chair as in claim 9 including:

a vertically reciprocal seat attached to said parallel guide posts.

13. A portable lift chair as in claim 12 including:

loops secured to said vertically reciprocal seat;

said loops extend around said parallel guide posts for guiding said vertically reciprocal seat vertically on said parallel guide posts.

14. A portable lift chair as in claim 13 including:

a foot rest secured to said vertically reciprocal seat;

a skirt shield attached to said vertically reciprocal seat for covering said bladder and preventing contact between a patient and said bladder.

* * * * *